US006064964A

United States Patent [19]

Yamamoto et al.

[11] Patent Number: 6,064,964

[45] Date of Patent: May 16, 2000

[54] DATA PROCESSING APPARATUS HAVING BREATH DETECTING FUNCTION AND IMAGE DISPLAY CONTROL METHOD USING BREATH DETECTION

[75] Inventors: Kenji Yamamoto; Kazuhiro Ohishi, both of Kawasaki, Japan

[73] Assignee: Fujitsu Limited, Kawasaki, Japan

[21] Appl. No.: 09/049,087

[22] Filed: Mar. 27, 1998

[30] Foreign Application Priority Data

Nov. 4, 1997 [JP] Japan ..... 9-302212

[51] Int. Cl.[7] ..... G10L 21/00; G10L 21/06; H04R 29/00

[52] U.S. Cl. ..... 704/270; 704/276

[58] Field of Search ..... 704/270, 276

[56] References Cited

U.S. PATENT DOCUMENTS 4,686,999 8/1987 Snyder et al. ..... 128/716
5,730,140 3/1998 Fitch ..... 128/701
5,765,135 6/1998 Friedman et al. ..... 704/276
5,778,341 6/1998 Zeljkovic ..... 704/256
5,853,005 12/1998 Scanlon ..... 128/662.03

*Primary Examiner*—David R. Hupspeth
*Assistant Examiner*—Susan Wieland
*Attorney, Agent, or Firm*—Staas & Halsey

[57] ABSTRACT

A data processing apparatus having breath detecting function and an image display control method using breath detection in such a data processing apparatus where in a breathing sound inputted by input means such as a microphone is detected, a feature quantity such as a voice power is transformed into another physical amount such as a temperature and a moving speed, and a display state of an image on a display screen or a driving state of a movable object such as a robot is controlled, whereby a user can feel that the user's breath directly operates the image and robot so that a feeling of physical disorder is eliminated, and thus a difference between the user and a virtual world on the display screen or robot is eliminated.

4 Claims, 8 Drawing Sheets

DATA PROCESSING APPARATUS HAVING BREATH DETECTING FUNCTION AND IMAGE DISPLAY CONTROL METHOD USING BREATH DETECTION

BACKGROUND OF THE INVENTION

The present invention relates to a data processing apparatus such as a personal computer and a portable game machine having a function for detecting as to whether a speech inputted by speech input means such as a microphone is a breathing sound, and relates to an image display control method using breath detection in such a data processing apparatus.

Conventionally, when moving an image on a display screen of a personal computer or successively changing a displayed state of an image in such a case of blowing up an image of a balloon, a method for moving the image by means of operations of cursor moving keys on the keyboard, a mouse or the like and for supplying a command to change the display state of the image is generally used.

In addition, there provides an application program such that words of a user inputted through a microphone are recognized to move an artificial life living in a virtual world on the display screen according to the inputted words, or such that a robot connected to a personal computer is moved according to the inputted words.

However, since it is quite different actions from the real breathing action to blow off or blow up a balloon on the display screen by means of the operations of a keyboard and mouse, the user feels a sense of incompatibility and that the virtual world on the display screen is different from the real world.

As mentioned above, the application program for moving an artificial life and a robot by means of words inputted through a microphone is effective in eliminating a distance between a user and a virtual world on the display screen or a robot, but this application program functions for moving and changing images on the display screen or for operating a robot according to breathing in/on without words.

BRIEF SUMMARY OF THE INVENTION

The present invention is devised in order to solve the above problem, and it is an object of the present invention to provide a data processing apparatus having breath detecting function such as a personal computer and a portable game machine, which detects a breathing sound inputted through input means such as a microphone, transforms a feature quantity such as the speech power into another physical amount such as a temperature and a moving speed to control a display state of an image on a display screen and a driving state of a movable object such as a robot so that a user can feel that user's breath directly operates the image and robot and a sense of incompatability is eliminated and distances between the user and a virtual world on the display screen and between the user and the robot are eliminated, and to provide an image display control method using breath detection in such a data processing apparatus.

In the present invention, a speech power and a feature quantity of a speech segment, which are elements featuring a speech inputted by input means such as a microphone, are detected, whether the inputted speech is a breathing sound is judged referring to the speech segment and decision rules stored in a dictionary, and when the inputted speech is a breathing sound, the speech power is transformed into information of another physical amount such as a temperature, speed or pressure based on the feature quantity such as the power of the speech and a feature of the speech decided from the feature quantity of the speech segment. Further, in the invention, the information of the physical amount is transformed into a display parameter such as a display color of the image on the screen, moving speed or moving distance.

As a result, the user can feel that the user's breath directly operates the image on the screen.

In addition, in the present invention, the information of the physical amount such as a speed and pressure obtained by transforming the speech power is transformed into a driving parameter such as a moving speed and moving distance or operating state of a movable object such as a robot.

As a result, the user can feel that the user's breath directly operates the movable object.

The above and further objects and features of the invention will more fully be apparent from the following detailed description with accompanying drawings.

BRIEF DESCRIPTION OF THE SEVERAL VIEWS OF THE DRAWING

FIGS. 7A through 7C are examples of a screen display when an image of a balloon moves by breathing on; and FIGS. 8A through 8C are examples of a screen display when a size of a balloon image changes by breathing in/on.

DETAILED DESCRIPTION OF THE INVENTION

Figure 1:
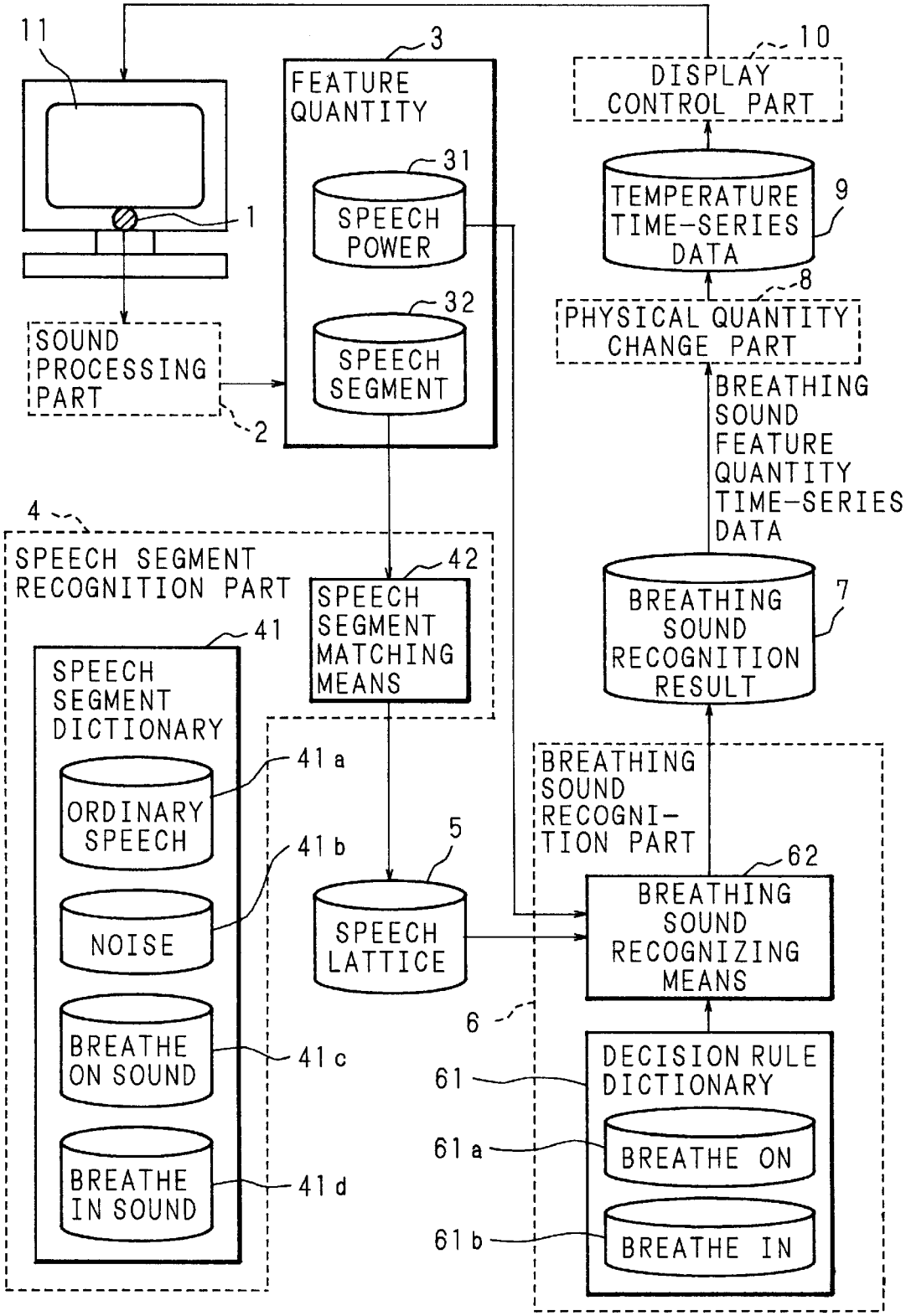
FIG. 1 is a diagram of an apparatus of the present invention.

FIG. 1 is the block diagram of a data processing apparatus having a breath detecting function of the present invention (hereinafter, referred to as the apparatus of the present invention), and a description will be given as to an example in the case where the apparatus of the present invention is applied to a personal computer. The apparatus according to embodiment to which the speech recognition technics is applied is described here.

In the drawings, numeral 1 denotes a microphone as input means, and it is provided to the central portion of the down edge of a display screen 11 in the present embodiment.

A sound processing part 2 performs conversion such as frequency analysis or linear prediction analysis on a sound signal inputted from the microphone 1 per short period of about 20 to 30 msec, for example to analyze the speech, and transforms the analyzed result into a feature vector sequence of about several dimensions to dozens dimensions, for example. According to this conversion, data of speech power 31 and speech segment 32 which is a feature quantity 3 of the sound signal inputted from the microphone 1 can be obtained.

A speech segment recognition part 4 divides the continuous sound signal into speech signals of phonemic unit or monosyllable unit which is convenient for speech recognition, and speech segment matching means 42 matches the speech segment with phonology of speech segment stored in a group of dictionaries of a ordinary speech 41*a,* noise 41*b,* breathe on sound 41*c* and breathe in sound 41*d* in a speech segment dictionary 41, and recognizes as to whether each speech segment (frame) of the inputted speech is the ordinary speech such as vowel and consonant, noise, breathe on sound or breathe in sound.

As a result of the speech segment recognition, a speech lattice 5 (see FIG. 2A) to which resemblance degree to dictionary data of each frame is added can be obtained.

Figures 2A, 2B:
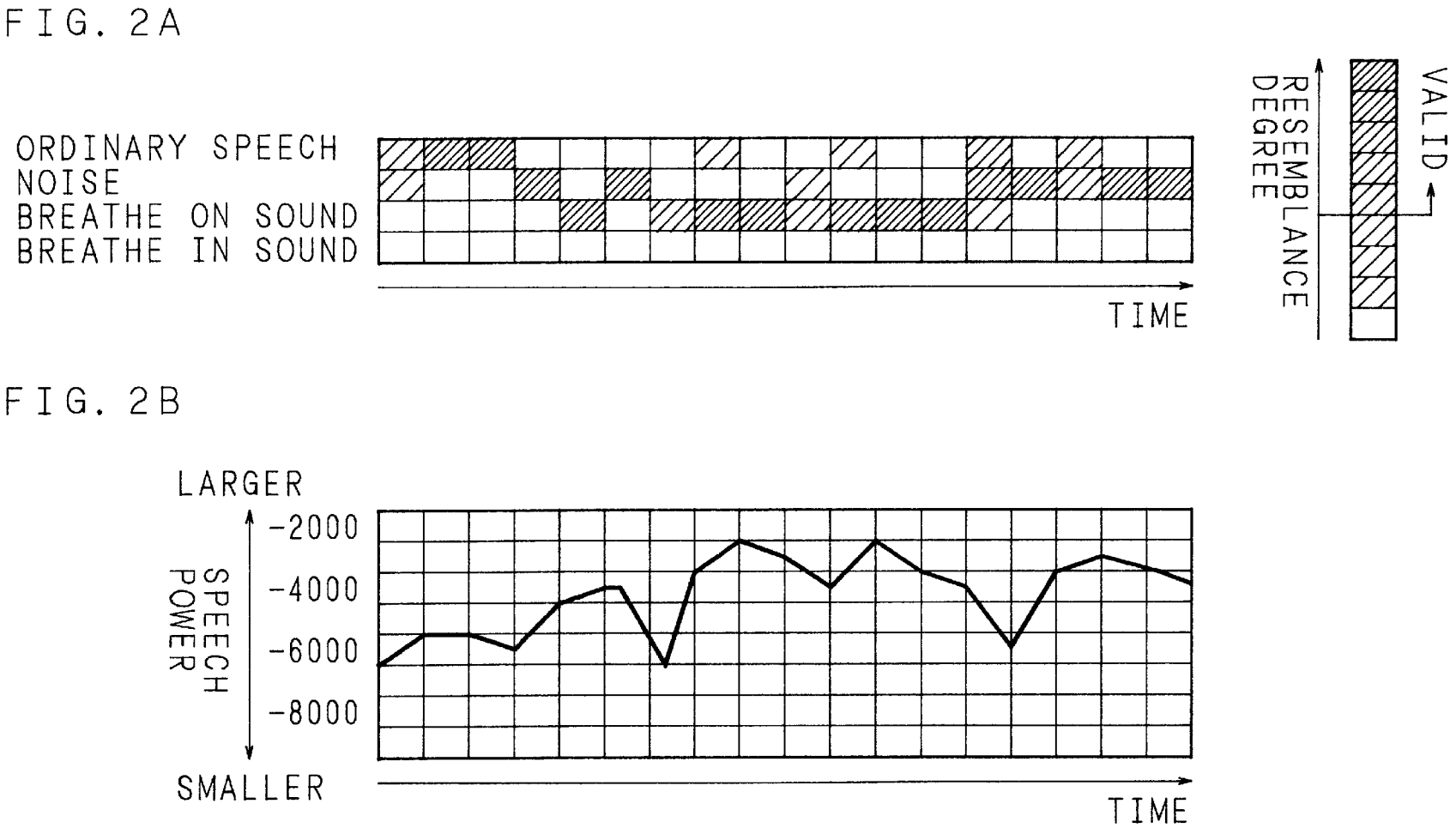
FIG. 2A is a diagram of a speech lattice of a breathing on sound.
FIG. 2B is a speech power diagram of a breathing on sound.

In FIG. 2A, in each frame of the ordinary speech, noise, breathe on sound and breathe in sound, the frame whose resemblance degree to the dictionary data is higher is shown with a deeper color (high-density hatching), and the frame whose resemblance degree is not less than a prescribed level is speech (effective).

In a breathing sound recognition part 6, breathing sound recognizing means 62 recognizes a breathing sound from the speech power 31 and speech lattice 5 detected as the feature quantity 3, referring to a decision rule dictionary 61 in which the number of continued frames to recognize the frames as a breathing sound and a speech other than the breathing sound, a threshold value of speech power to be judged as a breathing sound, and algorithm for judging whether a breathing sound or not based on the number of the continuation frames and the threshold value (see FIG. 4) are stored.

As the result of the breathing sound recognition, the speech lattice and speech power of the frame which was recognized as a breathing sound, namely, a breathing sound recognition result 7 (see FIG. 3) composed of time series data of the feature quantity of the breathing sound can be obtained.

A physical quantity change part 8 transforms the speech power into another physical amount such as a temperature, speed, distance or pressure based on the time series data of the feature quantity of the breathing sound recognition result 7. In the present embodiment, the speech power is transformed into a temperature so that temperature time series data 9 are obtained.

A display control part 10 transforms the temperature time series data 9 into a display parameter such as a display color, and as the temperature becomes higher, the color of the image on the display screen 11 becomes deeper red.

Figure 3A:
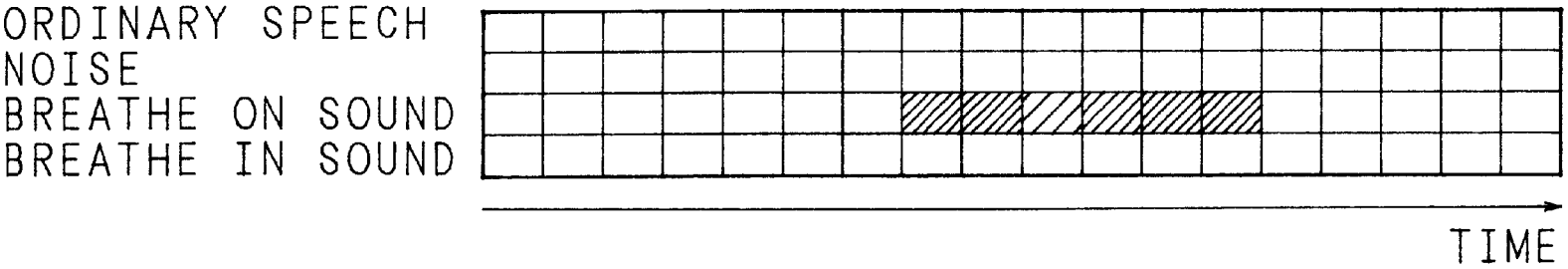
FIG. 3A is a diagram of a speech lattice of a breathing sound recognized result.
Figure 3B:
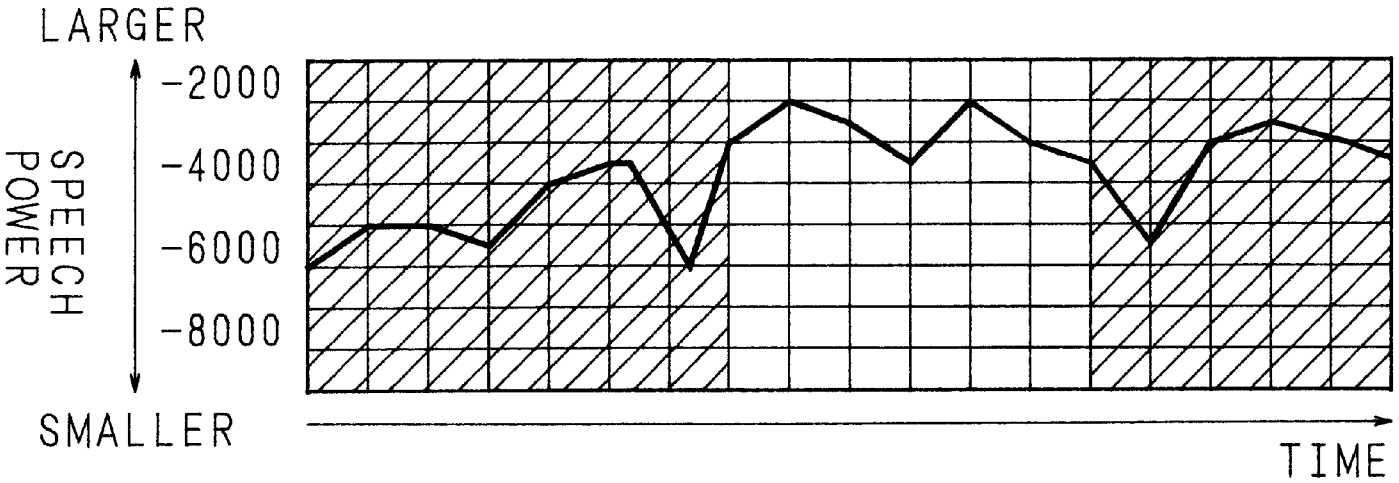
FIG. 3B is a speech power diagram of a breathing sound recognized result.
Figure 4:
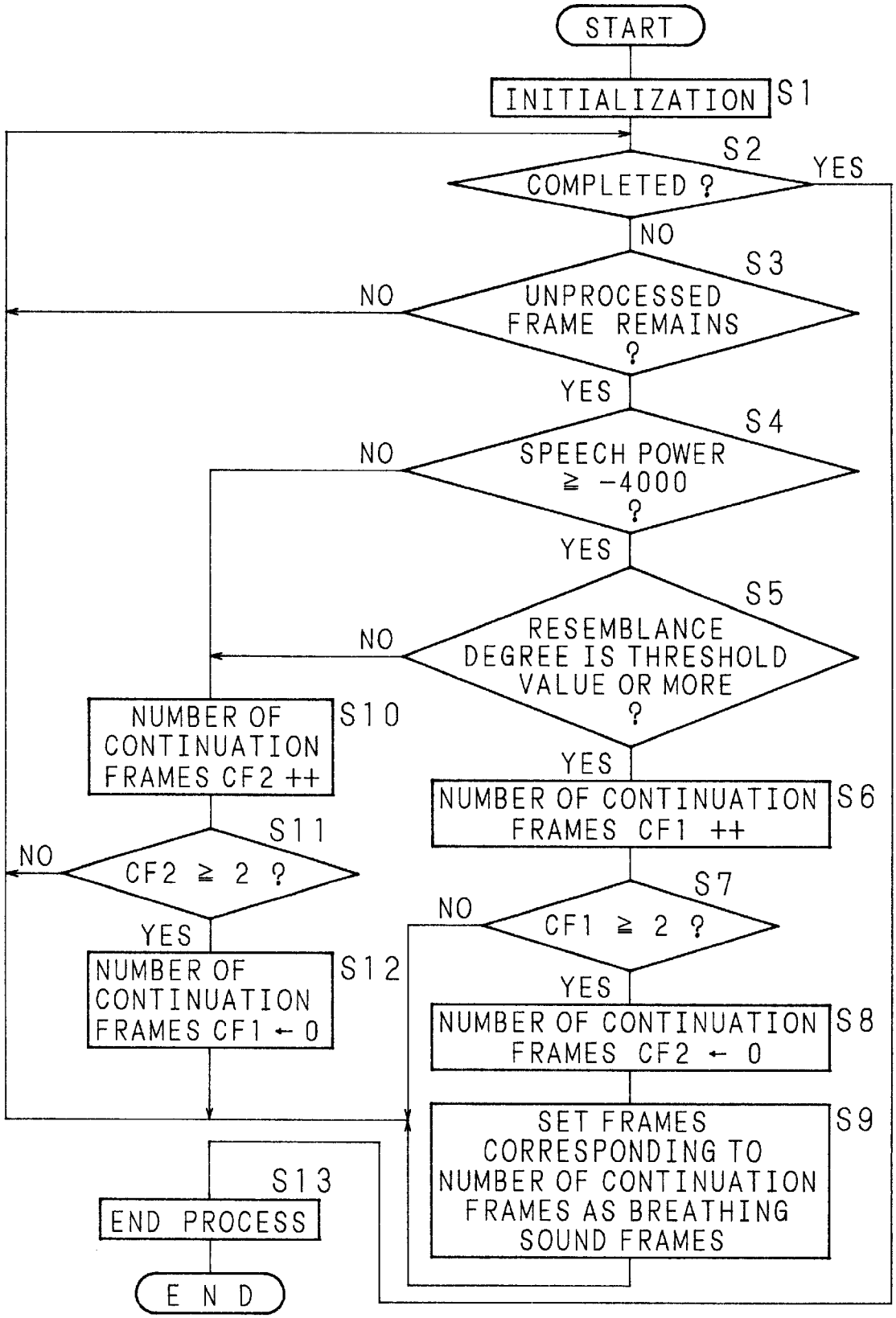
FIG. 4 is a flow chart of breathing sound judgment.

The following describes the procedure of breathing sound decision in the apparatus of the present invention making reference to the drawings of the speech lattice and speech power in FIGS. 2 and 3 and the flow chart in FIG. 4. In the present embodiment, as the decision rule of the decision rule dictionary 61, a threshold value of the speech power which is judged as a breathing sound is set to be −4000, the number of continuation frames which can be recognized as a breathing sound and speech other than the breathing sound is set to be 2, a variable for counting the number of continuation frames of the breathing sound is set to be CF1, and a variable for counting the number of continuation frames other than those of the breathing sound is set to be CF2.

The system is initialized (S1), whether a judging process for a breathing sound is ended is judged (S2), and whether an unprocessed frame exists is judged (S3). When an unprocessed frame exists, whether the speech power is −4000 or more is judged (S4).

When the speech power is −4000 or more, whether resemblance degree is a threshold value or more (namely, effective) is judged (S5). When the resemblance degree is the threshold value or more, the variable CF1 of the number of the continuation frames for the breathing sound is incremented by 1 (S6), and whether the number of the continuation frames for the breathing sound is 2 or more is judged (S7).

When the number of the continuation frames for the breathing sound becomes is 2 or more, 0 is substituted into the variable CF2 of the number of the continuation frames for the speech other than the breathing sound (S8), and the frames corresponding to the number of continuation frames are decided as breathing sound frames (S9).

Meanwhile, when the number of the continuation frames is 1, the sequence returns to S2, whether the judgment process is ended is judged (S2). Then whether an unprocessed frame exists is judged (S3), and when unprocessed frame exists, the sequence goes to the judging process for this frame.

Meanwhile, as a result of the judgment at S4, when the speech power of a frame to be judged is less than −4000 or even if not less than −4000, in the case where the resemblance degree does not reach the threshold value as a result of the judgment at S5, the variable CF2 of the number of the continuation frames for the speech other than the breathing sound is incremented by 1 (S10), and whether the number of continuation frames for the speech other than the breathing sound becomes not less than 2 is judged (S11).

When the number of continuation frames for the speech other than the breathing sound becomes not less than 2, 0 is substituted into the variable CF1 of the number of the continuation frames for the breathing sound (S12), and the sequence returns to S2 so that whether the judging process is ended is judged (S2). Then, whether an unprocessed frame exists is judged (S3), and when an unprocessed frame exists, the sequence goes to the judging process for this frame.

The above steps are repeated, and when an unprocessed frame does not exist, namely, the judging process is ended, a prescribed end process such as generation of the breathing sound recognition result 7 is performed (S13), and the judging process is ended.

The physical quantity change part 8 transforms the speech power of the breathing sound recognition result 7 obtained in the above manner into temperature time series data based on only the speech power or the feature of the speech (soft breathing sound "hah" or hard breathing sound "whooh") and the speech power.

Figure 5:
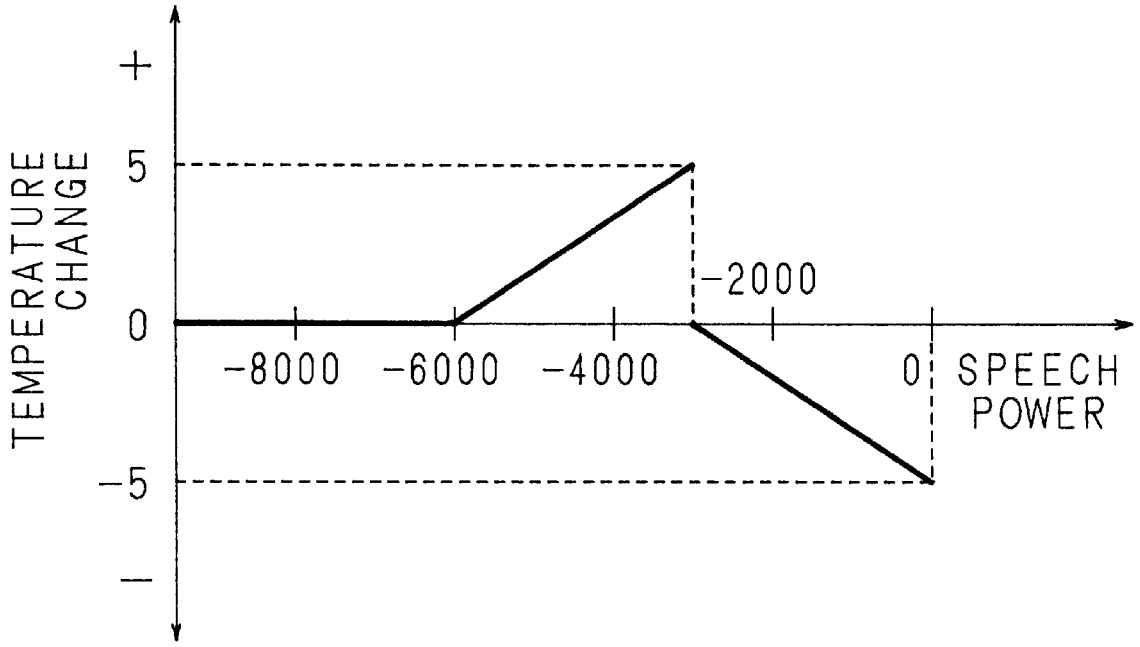
FIG. 5 is a diagram showing an example (1) of a. transform function from speech power to a temperature change.

FIGS. 5 and 6 are diagrams showing examples of the transform functions.

FIG. 5 shows a function such that a plus temperature change becomes gradually larger in proportion to the power in the region of comparatively weak power where the speech power is −6000 to −2000, and a minus temperature change becomes gradually larger in proportion to the power in the region of comparatively strong power where the speech power is −2000 to 0.

Figure 6A:
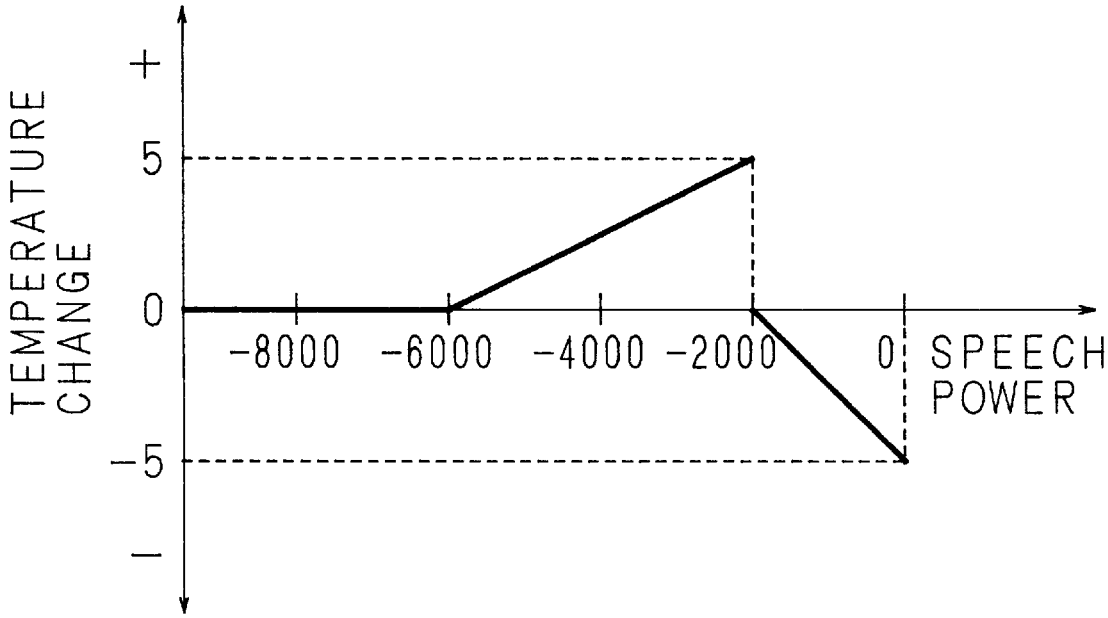
FIGS. 6A and 6B are diagrams showing another example (2) of a transform function from the speech power to the temperature change.
Figure 6B:
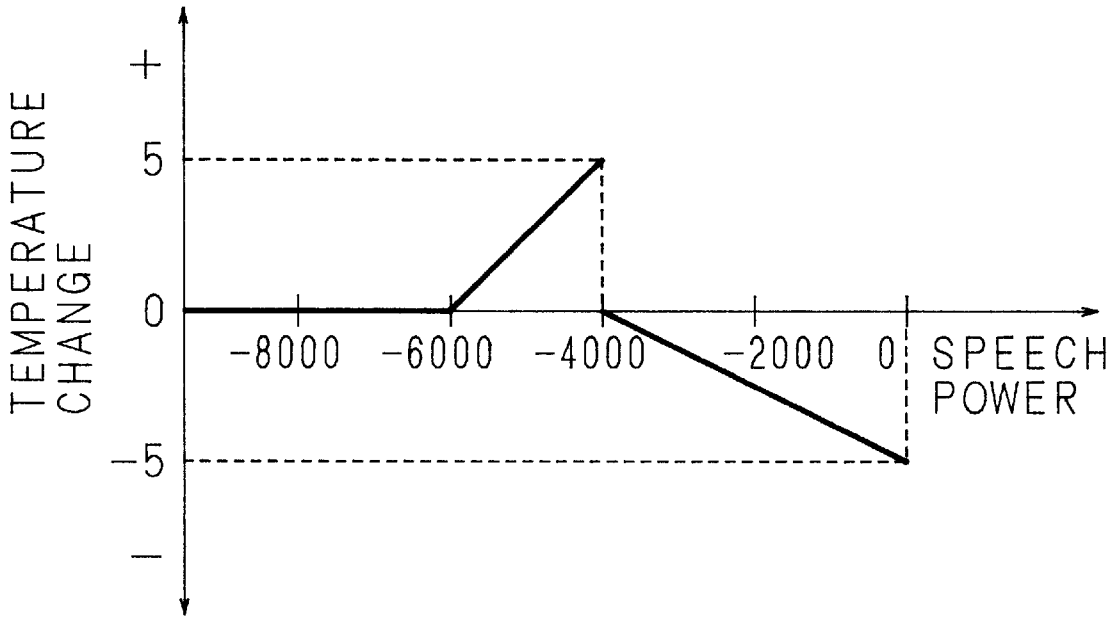

FIG. 6 shows a function such that in the case of a soft breathing sound "hah" (FIG. 6A), similarly to FIG. 5, a plus temperature change becomes gradually larger in proportion to the power in the region of comparatively weak power, and a minus temperature change becomes gradually larger in proportion to the power in the region of comparatively strong power.

Meanwhile, the function is such that in the case of the hard breathing sound "whoo" (FIG. 6B), a plus temperature change becomes gradually larger in proportion to the power in the region of comparatively weak power where the speech power is −6000 to −4000, and a minus temperature change becomes gradually larger in the range of comparatively strong power between −4000 and 0.

Here, the present embodiment describes the case where the number of microphones is 1, but a plurality of microphones can be used for detecting a direction of breathing, and the locating positions of the microphones are not limited to the lower-edge central portion of the display screen, so they may be located in any place on the display as long as a user can breathe in/on an image on the display screen in a natural posture as much as possible, and the microphones may be provided separately from the display unit.

In addition, the present embodiment describes the case where display of an image on the display screen 11 is controlled, the breathing sound power may be transformed into another physical quantity and this physical quantity may be transformed into a driving parameter of a movable object such as a robot connected to the personal computer, and the flower-shaped robot can be shaken by breathing in/on.

Further, the present embodiment describes the case where the apparatus of the present invention is a personal computer, but the apparatus of the present invention may be a portable personal computer having speech input means such as a microphone, a portable game machine, a game machine for home use, etc.

The present embodiment describes the case where the speech recognition technics is applied to the apparatus, but the apparatus may have a simple structure such as to detect only the breathing sound power and to change the power to another physical quantity, and in this case, informing means such as a button for informing the apparatus of breathing-in/on from the speech input means such as a microphone may be provided.

The following gives a concrete example of changing a display state of an image on the display screen using the apparatus of the present invention.

In the case where the speech power of breathing-on is transformed into time series data of a temperature, the following examples are possible: when breathing on, charcoal becomes red, the steam of a hot drink reduces, a flame of a candle and a light of a lamp go out.

In addition, in the case where the speech power of breathing-on is transformed into a speed, moving distance and moving direction, the following examples are possible: a balloon is let fly, ripples spread across the water, a liquid such as water colors is sprinkled like spray, a picture is drawn by breathing on water colors, agents are raced by breathing on them, and scrapings of a rubber eraser are beaten away.

Furthermore, in the case where the power of breathing sound is transformed into a breathing amount, the following examples are possible: a balloon is blown up, a balloon is deflated, a musical instrument such as a wind instrument is played by specifying an interval through a keyboard, and lung capacity is measured.

Figure 7A:
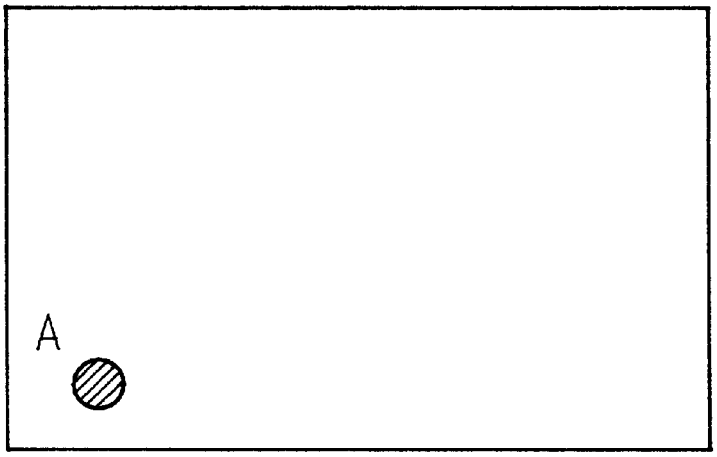
Figure 7B:
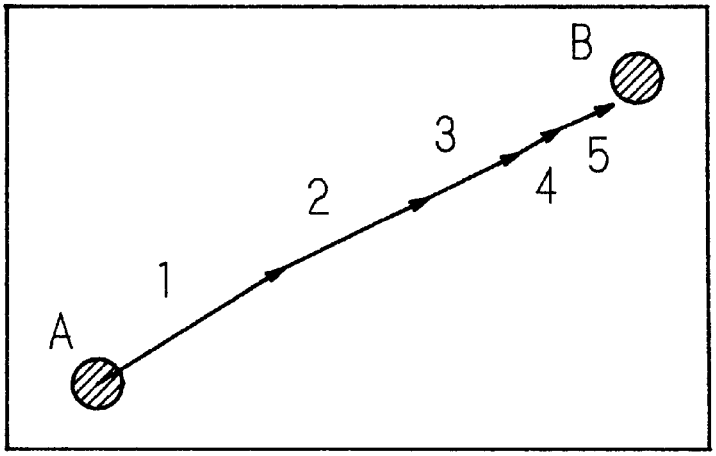
Figure 7C:
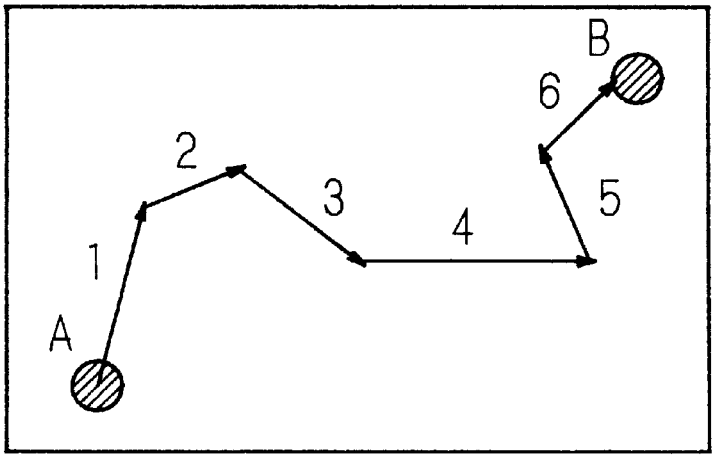

FIGS. 7A through 7C are drawings of a display example on the screen when an image of a balloon moves by breathing on. As shown in FIG. 7A, when the user breathes on the balloon image displayed on the spot A, the balloon image moves toward the spot B. The balloon image is preliminarily defined to move linearly as shown in FIG. 7B, or in zigzags as shown in FIG. 7C up to the position corresponding to the breathing power toward the spot B.

Further, the balloon image may be defined to move in a direction corresponding to a breathing direction of the user which is detected by plural microphones disposed and to a distance corresponding to the breathing power.

Figure 8A:
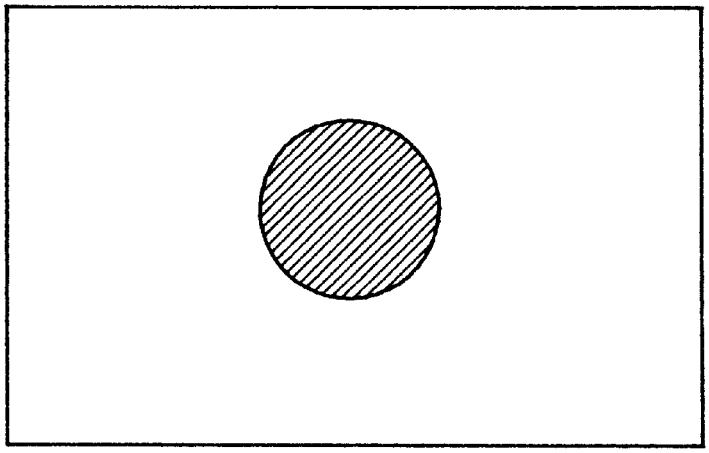
Figure 8B:
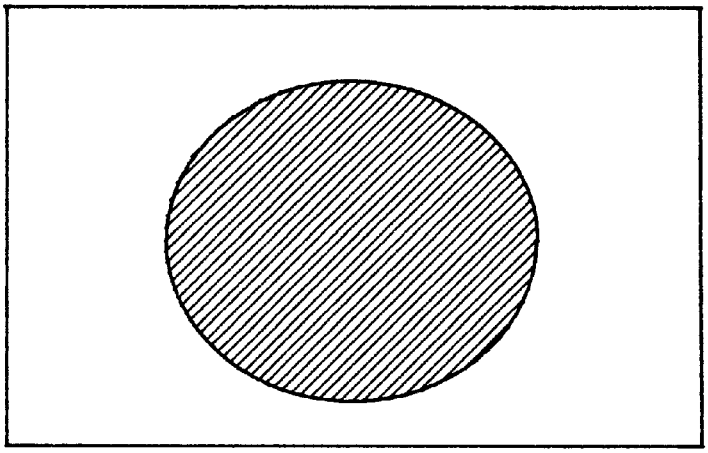
Figure 8C:
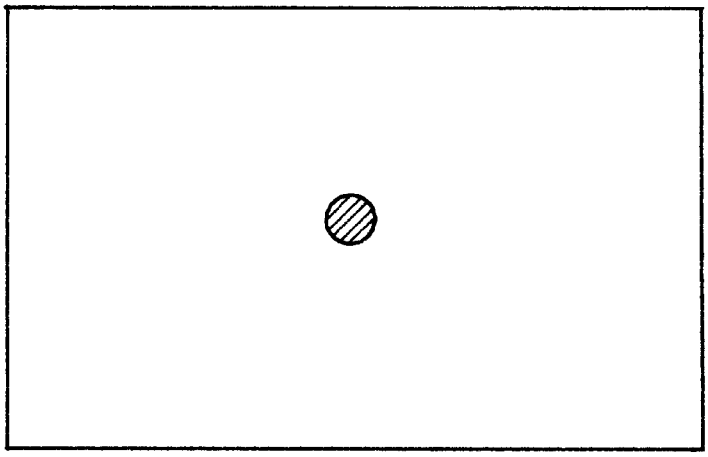

FIGS. 8A through 8C are drawings of a display example on the screen when size of a balloon image varies according to breathing on and breathing in. When the user breathes on the balloon image of size as shown in FIG. 8A, the balloon is inflated as shown in FIG. 8B. On the contrary, when the user breathe in the balloon image of size as shown in FIG. 8A, the balloon gets deflated.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A data processing apparatus, comprising:

means for inputting a speech;

means for detecting a feature quantity of an element featuring the speech inputted by said inputting means;

a dictionary which stores a speech segment comprising a breathing sound and a decision rule used for deciding whether the speech is a breathing sound based on the speech segment;

means for judging whether the speech inputted by said inputting means is a breathing sound by referring to said dictionary;

means for transforming a feature quantity of a prescribed element of the speech into information of another physical amount relevant to an object which is assumed to be changed when the object is blown by the breathing in a real world, based on the feature quantity of the element of the speech, as a result of the judgment by said judging means, when the speech inputted by said inputting means is a breathing sound; and means for transforming the information of the physical amount into prescribed information, whereby a breathing sound is detected from speech signals and display information relevant to the object and processed on the basis of the detection result is displayed.

2. A data processing apparatus, comprising:

means for inputting a speech;

a screen for displaying an image of an object;

means for controlling a display state of the image of the object on said screen according to a display parameter;

means for detecting a feature quantity of an element featuring the speech inputted by said inputting means;

a dictionary which stores a speech segment comprising a breathing sound and a decision rule used for deciding whether the speech is a breathing sound based on the speech segment;

means for judging whether the speech inputted by said inputting means is a breathing sound referring to said dictionary;

means for transforming a feature quantity of a prescribed element of the speech into information of another physical amount relevant to the object which is assumed to be changed when the object is blown by the breathing in a real world, based on the feature quantity of the element of the speech, as a result of the judgment by said judging means, when the speech inputted by said inputting means is a breathing sound; and means for transforming the information of the physical amount into the display parameter, whereby a breathing sound is detected from speech signals and display information relevant to the object and processed on the basis of the detection result is displayed.

3. A data processing apparatus, comprising:

means for inputting a speech;

a movable object;

driving means for driving said movable object;

means for controlling a driving state of said driving means according to a driving parameter;

means for detecting a feature quantity of an element featuring the speech inputted by said inputting means;

a dictionary which stores a speech segment comprising a breathing sound and a decision rule used for deciding whether the speech is a breathing sound based on the speech segment;

means for judging whether the speech inputted by said inputting means is a breathing sound referring to said dictionary;

means for transforming a feature quantity of a prescribed element of the speech into information of another physical amount relevant to the movable object which is assumed to be changed when the movable object is blown by the breathing in a real world, based on the feature quantity of the element of the speech, as a result of the judgment by said judging means, when the speech inputted by said inputting means is a breathing sound; and means for transforming the information of the physical amount into the driving parameter.

4. A method for controlling display of an image comprising the steps of:

detecting a feature quantity of an element featuring a speech inputted by means for inputting the speech;

judging whether the inputted speech is a breathing sound referring to a dictionary which stores a speech segment comprising a breathing sound and a decision rule used for deciding whether the speech is a breathing sound based on the speech segment;

transforming a feature quantity of a prescribed element of the speech into information of another physical amount relevant to an object which is assumed to be changed when the object is blown by the breathing in a real world, based on the feature quantity of the element of the speech as a result of the judgment, when the inputted speech is a breathing sound;

transforming the information of the physical amount into a display parameter; and controlling a display state of an image of the object on a screen according to the display parameter, whereby a breathing sound is detected from speech signals and display information relevant to the object processed on the basis of the detection result is displayed.

* * * * *